United States Patent [19]

Nolan

[11] Patent Number: 5,043,626

[45] Date of Patent: Aug. 27, 1991

[54] FLUORESCENT LAMP WITH COMPOSITE SAFETY COATING AND PROCESS OF MANUFACTURE

[76] Inventor: James D. Nolan, 16 Picket Ave., Spencer, N.C. 28159

[21] Appl. No.: 536,493

[22] Filed: Jun. 11, 1990

[51] Int. Cl.[5] ..... H01J 9/24; H01J 61/35

[52] U.S. Cl. ..... 313/489; 313/635; 313/312

[58] Field of Search ..... 313/489, 635, 312, 112, 313/117, 493, 44

[56] References Cited

U.S. PATENT DOCUMENTS

| | | | |
|---|---|---|---|
| 3,602,759 | 8/1971 | Evans | 313/112 |
| 3,808,495 | 4/1974 | Win | 313/110 |
| 4,507,332 | 3/1985 | Nolan et al. | 427/67 |
| 4,804,886 | 2/1989 | Nolan et al. | 313/489 |

*Primary Examiner*—Leo H. Boudreau
*Assistant Examiner*—Andrew W. Johns
*Attorney, Agent, or Firm*—R. Gale Rhodes, Jr.

[57] ABSTRACT

Composite safety coating and fluorescent lamp which lamp upon being energized causes the intermediate portion of the glass envelope to be heated to a relatively low temperature and causes the end portions of the glass envelope adjacent the end caps to be heated to a relatively high temperature, the composite safety coating includes a first substantially light transparent coating nondegradeable to the relatively low temperature surrounding and secured to the entire glass envelope and portions of the end caps, and second and third substantially light transparent coatings nondegradeable to the relatively high temperature surrounding the portions of the first coating surrounding the portions of the glass envelope heated to the relatively high temperature and portions of the end caps, the second and third coatings preventing degradation of the portions of the first coating surrounding the portions of the glass envelope heated to the relatively high temperature; and manufacturing process therefor.

19 Claims, 1 Drawing Sheet

FLUORESCENT LAMP WITH COMPOSITE SAFETY COATING AND PROCESS OF MANUFACTURE

BACKGROUND OF THE INVENTION

This invention is an improvement invention of the invention of U.S. Pat. No. 4,804,886 entitled ELECTRIC LAMP WITH COMPOSITE SAFETY COATING AND PROCESS OF MANUFACTURE, patented Feb. 14, 1989, James D. Nolan et al. inventors and James D. Nolan assignee (the Nolan Patent). The Nolan Patent and the references cited and referred to therein are hereby incorporated herein by reference.

More particularly, this invention relates to the combination of an electric lamp and a safety coating for preventing broadcasting of glass shards upon the glass envelope of the lamp being broken, and more particularly relates to the combination of a composite safety coating and fluorescent lamps providing high light output and very high light output which fluorescent lamps are known in the art as an HO fluorescent lamp; an example of such fluorescent lamp is the F96T12/CW/HO for 96", 1½" diameter Cool White High Output Lamp sold by Sylvania.

A diagrammatical illustration of an HO fluorescent lamp is shown in FIG. 1 of the incorporated Nolan Patent and which FIG. 1 is included in the present drawings for convenience of reference. Referring to FIG. 1 herein, the HO fluorescent lamp is indicated by general numerical designation 10 and includes a glass envelope 12 and end caps 14 and 16 provided at each end of the glass envelope and sealingly connected thereto in a manner known to those skilled in the art. The HO lamp, in the manner known to those skilled in the art, contains energization means (not shown) for generating high light output or very high light output upon energization of such means. As is still further known to those skilled in the art, upon such energization, the end portions of the glass envelope adjacent the end caps 14 and 26, identified in FIG. 1 as L1-L1, are heated to a first temperature much higher than the second temperature to which the intermediate portion of the glass envelope indicated by L2 is heated. For example, in one embodiment of an HO fluorescent lamp, the end portions L1-L1 of the glass envelope adjacent the end caps were heated to approximately 216° F. while the intermediate portion L2 of the glass envelope of the HO fluorescent lamp was heated to approximately 85° F. In the HO fluorescent lamp, the end portions L1-L1 measured approximately 2–2½ inches irrespective of the length L2 of the intermediate portion of the lamps. As taught in the Nolan Patent, it has been found that this substantial difference in temperatures between the end portions of glass envelope L1-L1 adjacent the end caps and the intermediate portion L2 of the glass envelope presents a difficult problem in providing the HO fluorescent lamp with a safety coating which is both effective in preventing broadcasting of glass shards upon the glass envelope 12 being broken and economically feasible with the cost of presently available fluorescent lamp coating materials. This is due, primarily, to the substantial difference in the cost of fluorescent lamp coating material which is non-degradable to the higher temperatures to which the glass envelope end portions L1-L1 are heated and the cost of lamp coating material which is non-degradable to the lower temperature to which the intermediate portion L2 of the fluorescent lamp is heated; the term non-degradable to a temperature means the temperature to which the coating material may be heated over the expected life of the lamp without the coating material melting, yellowing, or otherwise deteriorating and unacceptably diminishing the amount of light that may be transmitted therethrough.

It has been found that Teflon® (synthetic fluoropolymer resin) produced by E. I. DuPont de Nemours & Company, Inc. is a suitable coating material for coating the end portions L1-L1 adjacent the end caps of HO fluorescent lamps as the temperature to which Teflon is non-degradable is well above the higher temperatures to which the glass envelope end portions L1-L1 are heated. However, since the present cost of Teflon® is approximately $7.50 per foot of lamp coating, coating the entire length of a 96 inch or 8 foot HO fluorescent lamp with Teflon® becomes economically infeasible due to the prohibitive cost of approximately $56.25 per fluorescent lamp. Surlyn® (ionomer resin), another plastic made by DuPont, is a suitable coating material for coating the intermediate portion L1 of the HO fluorescent lamp since Surlyn® is non-degradable well above the lower temperature to which the glass envelope intermediate portion L2 is heated and since the present cost of Surlyn® is only approximately $0.16 per foot of lamp coating. However, as is known, Surlyn® degrades ruinously if heated to the higher temperatures to which the end portions L1-L1 of the glass envelope adjacent the end caps of the HO fluorescent lamp are heated.

The Nolan patent teaches three (3) invention embodiments each of which solves this coating problem by coating the shorter glass envelope end portions L1-L1 (FIG. 1) with respective first and second coatings of the more expensive Teflon® (nondegradable to the higher temperature) and by coating the longer intermediate glass envelope portion L2 with an intermediate coating of the less expensive Surlyn® (nondegradable to the lower temperature) and by interconnecting the inner end portions of the first and second coatings with the adjacent opposed end portions of the intermediate coating. In the invention embodiment of FIGS. 2–8 of the Nolan patent, the inner end portions of the first and second coatings 31 and 32 are interconnected with the adjacent opposed end portions of the intermediate coating 33 utilizing the interconnecting members 36 and 38 shown in FIGS. 2 and 8; in the invention embodiment of FIGS. 9–10 of the Nolan Patent the opposed end portions of the intermediate coating overlie the adjacent inner end portions of the first and second coatings 41 and 42 and these adjacent coating portions are interconnected by the interconnecting members 46 and 48 shown in FIG. 9 which interconnecting members partially surround the fluorescent lamp glass envelope substantially intermediate the transitions between end portions L1-L1 and the intermediate portion L2 of the glass envelope; and in the invention embodiment of FIGS. 11–15 of the Nolan Patent the inner end portions of the first and second coatings 141 and 142 overlie the adjacent opposed end portions of the intermediate coating 143 and these adjacent coating portions are interconnected using the interconnecting members 146 and 148 shown in FIG. 11 which interconnecting members are similar in shape and function to the aforementioned interconnecting members 36 and 38 (FIG. 2 of the Nolan Patent).

As further taught in the Nolan patent with regard to the process of manufacturing embodiments, first the entire glass envelope 12 (FIG. 1) of the fluorescent lamp 10 is coated with the less expensive coating material nondegradable to the lower temperature, e.g. Surlyn ®, next the portions of the Surlyn ® covering the end portions L1-L1 of the glass envelope are removed and then the more expensive coatings nondegradable to the higher temperature, e.g. Teflon ®, are applied over the end portions L1-L1 of the glass envelope 12 and portions of the end caps, whereafter the adjacent portions of the coatings are interconnected as taught above. Alternatively, the end portions L1-L1 of the glass envelope 12 are masked (e.g. by mask 80 of the Nolan Patent) and the intermediate portion L2 of the glass envelope 12 coated with the less expensive coating material nondegradable to the lower temperature, e.g. Surlyn ®, next the mask is removed and the end portions L1-L1 of the glass envelope and portions of the end caps 14 and 16 are coated with the more expensive coating material nondegradable to the higher temperature, e.g. Teflon ®, and then the adjacent portions of the coatings are interconnected as taught above.

While at least one of such invention embodiments of the Nolan Patent has achieved commercial success, numerous of such embodiment having been sold, there exists a need in the art to reduce the cost of such fluorescent lamp with composite safety coating and to reduce the manufacturing cost thereof.

SUMMARY OF THE INVENTION

The object of the present invention is to satisfy the foregoing needs in the fluorescent lamp with composite safety coating art.

The present invention is based on the discovery that the manufacturing cost, and attendant end product cost, associated with the manufacturing steps taught in the Nolan Patent of (i) either removing the portions of the less expensive first applied coating non-degradable to the lower temperature (e.g. Surlyn ®) from the end portions L1-L1 (FIG. 1) of the glass envelope 12 before the end portions L1-L1 of the glass envelope are coated with the more expensive coatings nondegradable to the higher temperature (e.g. Teflon ®), or (ii) first masking the end portions L1-L1 of the glass envelope before the intermediate portion L2 thereof is coated with the less expensive coating nondegradable to the lower temperature (e.g. Surlyn) and then unmasking the glass envelope end portions L1-L1 and coating them with the more expensive coatings nondegradable to the higher temperature (e.g. Teflon ®), can be eliminated by first coating the entire glass envelope 12 of FIG. 1 (end portions L1-L1 heated to the higher temperature and intermediate portion L2 heated to the lower temperature) and portions of the end caps 14 and 16 with the less expensive coating nondegradable to the lower temperature and next by coating the portions of the previously applied coating nondegradable to the lower temperature overlying the end portions L1-L1 and portions of the end caps 14 and 16 with the more expensive coatings nondegradable to the higher temperature. While not wishing to be bound by theory, it is believed that the coatings nondegradable to the higher temperature overlying the portions of the coating nondegradable to the lower temperature deny ambient air or oxygen access to the underlying portions of the coating nondegradable to the lower temperature whereby upon the portions of the coating nondegradable to the lower temperature overlying the glass envelope end portions L1-L1 being heated to the higher temperature such portions of the coating nondegradable to the lower temperature do not degrade.

Fluorescent lamp with composite safety coating which satisfies the foregoing object and embodies the present invention may include a fluorescent lamp which upon being energized causes the intermediate portion of the glass envelope to be heated to a relatively low temperature and causes the end portions of the glass envelope adjacent the end caps to be heated with a relatively high temperature, and a composite safety coating which includes a first substantially light transparent coating nondegradable to the relatively low temperature surrounding and secured to the entire glass envelope and portions of the end caps, and second and third substantially light transparent coatings nondegradable to the relatively high temperature surrounding the portions of the first coating surrounding the portions of the glass envelope heated to the relatively high temperature and portions of the end caps; the second and third coatings prevent degradation of the portions of the first coating surrounding the portions of the glass envelope heated to the relatively high temperature and the present invention also includes a manufacturing process for such fluorescent lamp with composite safety coating.

DESCRIPTION OF THE PREFERRED EMBODIMENT

Figure 1:
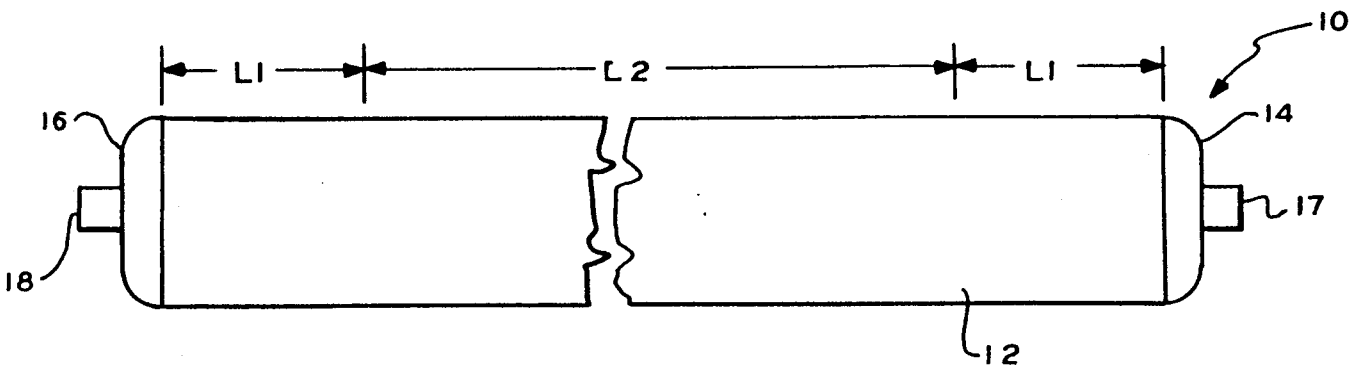
FIG. 1 PRIOR ART
FIG. 1 is a diagrammatical illustration of a HO fluorescent lamp known to the prior art.
Figure 2:
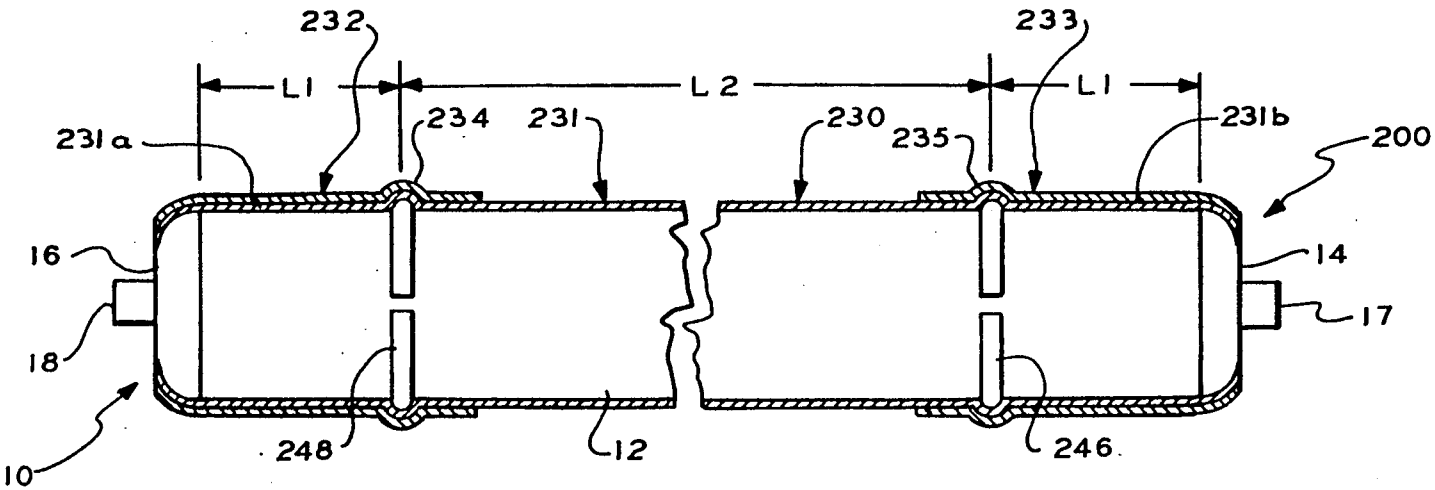
FIG. 2 is a diagrammatical illustration in cross-section of the combination of an HO fluorescent lamp and composite safety coating according to the present invention.

Referring now to FIG. 2, there is shown a fluorescent lamp with composite safety coating embodying the present improvement invention and indicated by general numerical designation 200. The fluorescent lamp with composite safety coating 200 may include the fluorescent lamp indicated by general numerical designation 10 and the composite safety coating indicated by general numerical designation 230; the fluorescent lamp 10 may be of the HO type noted above which upon being energized by energization means (not shown) causes the end portions L1-L1 of the glass envelope 12 to be heated to a relatively high temperature and causes the intermediate portion L2 of the glass envelope 12 to be heated to a relatively low temperature.

The composite safety coating 230, FIG. 2, may include a first substantially light transparent coating 231 including a first end portion **231*a* surrounding and secured to the leftward end portion L1 of the glass envelope 12 and a portion of the end cap 16, a second end portion 231*b* surrounding and secured to the rightward end portion L1 of the glass envelope 12 and a portion of the end cap 14, and an intermediate portion surrounding and secured to the intermediate portion L2 of the glass envelope 12. The composite safety coating 230 may further include a second substantially light transparent coating 232 surrounding and secured to the first end portion 231*a* of the first substantially light transparent coating 231 surrounding and secured to at least the leftward end portion L1 of the glass envelope 12 and the end cap 16. Still further, the composite safety coating 230 may include a third substantially light transparent coating 233 surrounding and secured to the second end portion 231***b* of the first substantially light transparent coating 231 surrounding and secured to the rightward end portion L1 of the glass envelope 12 and the portion of the end cap 14.

It will be noted from FIG. 2 that in the preferred embodiment of the present improvement invention the second and third substantially light transparent coatings 232 and 233 include, respectively, inner end portions 234 and 235 overlying the portions of the first substantially light transparent coating 231 generally overlying the transitions between the end portions L1-L1 of the glass envelope 12 and the intermediate portion L2 of the glass envelope. Further, as may be understood from FIG. 2 in the preferred embodiment of the present improvement invention, the composite safety coating 230, if desired or required, may further include interconnecting members 248 and 246 surrounding the glass envelope 12 and generally overlying the noted transitions; however, it will be understood that such interconnecting members 246 and 248 are not required if sufficient interconnection is achieved between the second and third coatings 232 and 233 to the underlying end portions 231*a* and 231*b* of the first coating 231 in the process of surrounding and securing the second and third coatings thereto to cause the first, second and third coatings 231, 232 and 233 to contain the end caps 14 and 16 and glass shards produced upon the glass envelope 12 being broken. The interconnecting members 246 and 248, in the preferred embodiment, facilitate interconnection between the inner end portions 234 and 235 of the second and third substantially light transparent coatings 232 and 233 and the portions of the first substantially light transparent coating 231 generally overlying the noted transitions. As may be further noted from FIG. 2, the interconnecting members 246 and 248 may be generally annular members, and still more particularly may each be a metal (e.g. a suitable steel) annulus slit substantially transversely to permit thermal expansion thereof upon energization and heating of the fluorescent lamp 10. The interconnecting members 246 and 248 as shown in FIG. 2 impart interconnected configurations to the inner end portions 234 and 235 of the second and third substantially light transparent coatings 232 and 233 and the portions of the first substantially light transparent coating 231 generally overlying the above-noted transitions between the end portions L1-L1 of the glass envelope 12 and the intermediate portion L2 thereof. Still more specifically as shown in FIG. 2, the annular interconnecting members 246 and 248 impart radially outwardly extending ridges to the portions of the first substantially light transparent coating 231 generally overlying the noted transitions and impart radially outwardly extending circular grooves to the inner end portions 234 and 235 of the respective second and third substantially light transparent coatings 232 and 233 with the ridges being received within the grooves to facilitate interconnection between the inner end portions 234 and 235 of the second and third substantially light transparent coatings 232 and 233 and the portions of the first substantially light transparent coating 231 generally overlying the above-noted transitions; such ridges and grooves as shown in FIG. 2 are generally concentric with respect to the annular interconnecting members 248 and 246.

The first substantially light transparent coating 231 (FIG. 2) is nondegradable at least to the above-noted relatively low temperature and may be an integrally formed coating of Surlyn® (ionomer resin) formed in situ and surrounding and fused to the end portions L1-L1 of the glass envelope 12, the intermediate portion L2 of the glass envelope, and portions of the end caps 14 and 16 and formed in accordance with the coating process disclosed in U.S. Pat. No. 4,507,332 entitled METHODS FOR COATING THE GLASS ENVELOPE AND PREDETERMINED PORTIONS OF THE END CAPS OF A FLUORESCENT LAMP, patented Mar. 26, 1985, James D. Nolan et al inventors; alternatively, the first substantially light transparent coating 231 may be a suitable heat-shrinkable substantially light transparent plastic sleeve of material nondegradable to the above-noted relatively low temperature, e.g. a Surlyn® (ionomer resin) heat shrinkable plastic sleeve, which plastic sleeve may be heat shrunk or constricted over the portions of the fluorescent lamp 10 underlying the coating 231 shown in FIG. 2 in accordance with the teachings disclosed in U.S. Pat. No. 3,602,759 entitled ELECTRIC LAMP WITH PROTECTIVE ENCLOSURE HAVING SHRUNK PLASTIC RETAINING MEANS, PATENTED Aug. 31, 1971, George S. Evans inventor.

The second and third substantially light transparent coatings 232 and 233 may be suitable heat-shrinkable substantially light transparent plastic sleeves of suitable material nondegradable to the above-noted relatively high temperature, e.g. Teflon® (synthetic fluoropolymer resin) heat-shrinkable plastic sleeves and which sleeves may be heat shrunk or constricted respectively over the underlying portions of the first substantially light transparent coating 231 as shown in FIG. 2 in accordance with the teachings of the above-noted Evans patent. As noted above, it has been discovered that the second and third coatings 232 and 233 prevent the underlying end portions 231*a* and 231*b* of the first coating 231 from degrading upon the end portions L1-L1 of the fluorescent lamp being heated to the relatively high temperature although the first coating 231 is only nondegradable to the relatively low temperature.

It will be understood that in accordance with the teachings of the present invention the composite safety coating 230 (FIG. 2) upon the glass envelope 12 being broken into glass shards maintains the glass shards and the end caps 14 and 16 in association within the composite safety coating 230 to prevent broadcasting of the glass shards.

It will be understood that many variations and modifications may be made in the present invention without departing from the spirit and the scope thereof.

What is claimed is:

1. In combination a composite safety coating and fluorescent lamp which lamp upon being energized causes the intermediate portion of the glass envelope thereof to be heated to a relatively low temperature and causes the end portions of the glass envelope adjacent the fluorescent lamp end caps to be heated to a relatively high temperature, the composite safety coating including a first substantially light transparent coating nondegradable to the relatively low temperature surrounding the secured to the entire glass envelope and portions of the end caps, and second and third substantially light transparent coatings nondegradable to the relatively high temperature surrounding and secured to the portions of the first coating surrounding and secured to the end portions of the glass envelope heated to the relatively high temperature and portions of the end caps, the second and third coatings preventing degradation of the portions of the first coating surrounding and secured to the end portions of the glass envelope heated tot he relatively high temperature.

2. In combination a composite safety coating and fluorescent lamp which lamp upon being energized causes the intermediate portion of the glass envelope thereof to be heated to a relatively low temperature and causes the end portions of the glass envelope adjacent the fluorescent lamp end caps to be heated to a relatively high temperature, the composite safety coating including a first substantially light transparent coating nondegradable to the relatively low temperature surrounding the secured to the entire glass envelope and portions of the end caps, and second and third substantially light transparent coatings nondegradable to the relatively high temperature surrounding and secured to the portions of the first coating surrounding and secured tot he end portions of the glass envelope heated to the relatively high temperature and portions of the end caps, the second and third coating having inner end portions interconnected with respective portions of the first coating generally overlying respective transitions between the intermediate portion of the glass envelope and the end portions of the glass envelope, and the first and second coatings preventing degradation of the portions of the first coating surrounding and secured to the end portions of the glass envelope heated to the relatively high temperature.

3. Fluorescent lamp according to claim 2 wherein the composite coating includes interconnecting members provided generally at the respective transitions between the intermediate portion of said glass envelope and the end portions of the glass envelope and wherein the interconnecting members facilitate interconnection between the inner end portions of the second and third coatings and the respective portions of the first coating generally overlying the respective transitions.

4. Fluorescent lamp with composite safety coating, comprising:

a fluorescent lamp including a glass envelope, a first end cap provided on one end of said glass envelope and a first connecting pin extending outwardly from said first end cap, a second end cap provided on the opposite end of said glass envelope and a second connecting pin extending outwardly from said second end cap, said glass envelope containing energization means for generating light emanating from said lamp and upon energization thereof a first portion of said glass envelope adjacent said first end cap and a second portion of said glass envelope adjacent said second end cap being heated to a first temperature and an intermediate portion of said glass envelope intermediate said first and second portions of said glass envelope being heated to a second temperature lower than said first temperature;

composite safety coating including:

(i) a first substantially light transparent coating including a first portion surrounding and secured to said first portion of said glass envelope and surrounding and secured to a portion of said first end cap, a second portion surrounding and secured to said second portion of said glass envelope and surrounding and secured to a portion of said second end cap, and an intermediate portion intermediate said first and second portions and surrounding and secured to said intermediate portion of said glass envelope, (ii) a second substantially light transparent coating surrounding and secured to said first portion of said first coating, and (iii) a third substantially light transparent coating surrounding and secured to said second portion of said first coating, and (iv) said second and third coatings nondegradable to at least said first temperature and said first coating nondegradable to at least said second temperature, said second and third coatings preventing degradation of said first and second portions of said first coating upon said first and second portions of said first coating being heated to said first temperature; and upon said glass envelope being broken into glass shards said composite safety coating maintaining said glass shards and said end caps in association within said composite safety coating to prevent broadcasting of said glass shards.

5. Fluorescent lamp according to claim 4 wherein said second and third coatings have inner end portions, wherein said composite coating includes interconnecting members provided generally at the respective transitions between said first and second portions of said glass envelope and said intermediate portion of said glass envelope and wherein said interconnecting members facilitate interconnection between said inner end portions of said second and third coatings and respective portions of said first coating generally overlying said respective transitions.

6. Fluorescent lamp according to claim 5 wherein said interconnecting members at least partially surround said glass envelope substantially at said respective transitions and wherein said respective portions of said first coating generally overlying said respective transitions underlie said inner end portions of said second and third coatings and overlie said interconnecting members 7. Fluorescent lamp according to claim 6 wherein each of said interconnecting members is a metal annulus slit substantially transversely to permit thermal expansion thereof upon energization of said energization means.

8. Fluorescent lamp according to claim 5 wherein said interconnecting members comprise generally annular members which impart interconnected configurations to said inner end portions of said second and third coatings and said respective portions of said first coating generally overlying said transitions.

9. Fluorescent lamp according to claim 8 wherein said annular members have a generally circular cross-section, wherein said annular members impart radially outwardly extending circular ridges to said portions of said first coating generally overlying said transitions and impart radially outwardly extending circular grooves to said inner end portions of said second and third coatings, wherein said ridges are received within said grooves to interconnect said inner end portions of said second and third coatings with said portions of said first coating generally overlying said transitions to provide said interconnected configurations, and wherein said ridges and grooves are generally concentric with respect to said annular members.

10. Fluorescent lamp according to claim 4 wherein said first coating comprises an integrally formed coating of substantially light transparent plastic material formed in situ and surrounding and fused to said first and second and intermediate portions of said glass envelope and to said portions of said first and second end caps.

11. Fluorescent lamp according to claim 4 wherein said first coating comprises a heat-shrunk sleeve of heat shrinkable plastic material.

12. Fluorescent lamp according to claim 4 or 10 wherein said second and third coatings comprise heat-shrunk sleeves of heat shrinkable plastic material.

13. Fluorescent lamp according to claim 12 wherein said heat-shrinkable plastic material is synthetic fluoropolymer resin.

14. Fluorescent lamp according to claim 10 wherein said plastic material is ionomer resin.

15. Process of providing a fluorescent lamp with a composite safety coating, said fluorescent lamp including a glass envelope, a first end cap provided on one end of said glass envelope and a first connecting pin extending outwardly from said first end cap, a second end cap provided on the opposite end of said glass envelope and a second connecting pin extending outwardly from said second end cap, said glass envelope containing energization means for generating light emanating from said lamp and upon energization thereof a first portion of said glass envelope adjacent said first end cap and a second portion of said second glass envelope adjacent said second end cap being heated to a first temperature and an intermediate portion of said glass envelope intermediate said first and second portions of said glass envelope being heated to a second temperature lower than said first temperature, said process comprising the steps of:

coating said first, second and intermediate portions of said glass envelope and portions of said first end caps with a first coating nondegradable to at least said second temperature; and coating the portion of said first coating overlying said first portion of said glass envelope and said portion of said first end cap and the portion of said first coating overlying said second portion of said glass envelope and said portion of said second end cap respectively with second and third substantially light transparent coatings nondegradable to at least said first temperature; and said second and third coatings preventing degradation of said portions of said first coating surrounding said first and second portions of said glass envelope upon said first and second portions of said glass envelope being heated to said first temperature.

16. Process according to claim 15 wherein said first coating is provided by integrally forming said first coating in situ from a plastic material substantially transparent to light and nondegradable to at least said second temperature.

17. Process according to claim 15 wherein said first coating is provided by surrounding said first and second portions of said glass envelope and said portions of said first and second end caps with a sleeve of substantially light transparent heat-shrinkable plastic nondegradable to at least said second temperature and heating shrinking said sleeve into engagement with said first, second and intermediate portions of said glass envelope and said portions of said first and second end caps.

18. Process according to claim 15, 16 or 17, wherein said second and third coatings are provided by surrounding said portions of said first coating surrounding said first and second portions of said glass envelope and said portions of said first and second end caps with second and third sleeves of substantially light transparent heat-shrinkable plastic nondegradable to at least said first temperature and heat shrinking said second and third sleeves into engagement with said portions of said first coating surrounding said first and second portions of said glass envelope and said portions of said first and second end caps.

19. Process according to claim 15 wherein said process includes the initial step of surrounding said glass envelope at the respective transitions between said first and second glass portions and said intermediate glass portion with interconnecting members, and wherein portions of said first coating generally overlying said respective transitions are provided over said interconnecting members, wherein said second and third coatings have inner portions provided over said portions of said first coating provided over said interconnecting members, and wherein said interconnecting members facilitate interconnection between said inner end portions of said second and third coatings and said portions of said first coating overlying said interconnecting members by imparting interconnected configurations thereto.

* * * * *